US006402397B1

(12) United States Patent
Piccinino, Jr. et al.

(10) Patent No.: US 6,402,397 B1
(45) Date of Patent: Jun. 11, 2002

(54) PHOTOGRAPHIC PROCESSOR HAVING A FILTER HOUSING WITH A LEVEL SENSING PROBE

(75) Inventors: Ralph L. Piccinino, Jr., Rush; Walter D. Foley, Colton; Daniel C. Davis, Rush, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/747,738

(22) Filed: Dec. 22, 2000

(51) Int. Cl.[7] ..... G03D 13/00
(52) U.S. Cl. ..... 396/565; 396/626; 396/578
(58) Field of Search ..... 396/565, 626, 396/617–622, 636, 578; 219/494

(56) References Cited

U.S. PATENT DOCUMENTS 4,182,567 A 1/1980 Laar et al.
4,669,847 A 6/1987 Taniguchi et al.
5,057,191 A * 10/1991 Kurematsu et al. ..... 203/3
5,175,792 A * 12/1992 Lefebvre ..... 219/494
5,432,581 A 7/1995 Patton et al.
5,508,776 A 4/1996 Rosenburgh et al.
5,701,540 A 12/1997 Rosenburgh et al.
5,753,111 A 5/1998 Patton et al.

* cited by examiner

*Primary Examiner*—D. Rutledge
(74) *Attorney, Agent, or Firm*—David A. Novais

(57) ABSTRACT

A processing apparatus, method and recirculation system utilizes a level sensing probe in a filter housing of the filter assembly. The level sensing probe is adapted to provide a signal to a controller arrangement that includes at least a level sensing circuit, a central processing unit and a solid state relay. The controller arrangement is adapted to shut off a heating element of the filter assembly whenever the solution in the filter housing as defined by the level sensing probe falls below an acceptable minimum level of processing solution. With the arrangement of the present invention, it is possible to maintain re-circulated and/or replenished processing solution in the filter housing at an acceptable minimum level, and whenever the solution falls below such a level the heating element is shut off so as to prevent the overheating of the components of the filter assembly.

14 Claims, 2 Drawing Sheets

PHOTOGRAPHIC PROCESSOR HAVING A FILTER HOUSING WITH A LEVEL SENSING PROBE

FIELD OF THE INVENTION

The present invention relates to photographic processors, as well as a filter assembly for a photographic processor which includes a level sensing probe.

BACKGROUND OF THE INVENTION

Conventional photographic processors are typically provided with a filter assembly disposed in a recirculation system. The filter assembly is effective for filtering particles in a processing solution that is being re-circulated. A conventional filter assembly includes an inlet port for receiving processing solution from a processing tank for recirculation, and an outlet port for delivering the filtered solution back to the processing tank. The conventional filter assembly further includes a heating element for heating the processing solution while in the filter assembly. The heating element is usually connected to sensors that measure the temperature either within a filter housing of the filter assembly or at some other point in the processing system (see for example, U.S. Pat. Nos. 5,701,540 and 5,753,111).

A drawback with conventional filter assemblies is that the heating element is responsive to a temperature within the filter housing as opposed to a level of processing solution within the filter housing. Therefore, the heating element in a conventional filter assembly remains in an activated or on state regardless of the level of solution in the filter housing. This causes a problem in that components of the filter housing could overheat when the solution level within the filter housing falls below an acceptable level while the heating element is still on. This could adversely effect the operation of the filter assembly and its associated processing equipment.

SUMMARY OF THE INVENTION

An object of the present invention is to provide for a photographic processor having a filter assembly that includes a filter housing which overcomes the above-mentioned drawbacks. More specifically, the present invention provides for a filter housing having a level sensing probe which is designed to assure that the level of processing solution in the filter housing is at a proper height to prevent an overheating of components of the filter housing.

With the system and method of the present invention, if the processing solution level within the filter housing drops below an acceptable level, for whatever reason, the heating element is automatically shut off. This will prevent any damage to the filter housing or components of the filter assembly due to overheating when the solution drops below an acceptable level, and when the solution pump is recirculating processing solution.

The present invention accordingly relates to a processing apparatus for processing photographic material. The apparatus comprises a processor, a circulation system for circulating processing solution to and from the processor, a filter assembly provided in the circulation system, with the filter assembly comprising a filter housing having a heating element therein; a level sensing probe provided on the filter housing; and a controller arrangement operationally associated with the level sensing probe and the heating element. The controller arrangement is adapted to turn off the heating element when the processing solution in the filter housing falls below a level on the filter housing as defined by the level sensing probe.

The present invention also relates to a filter assembly for a photographic processor. The filter assembly comprises a filter housing adapted to hold a processing solution; a heating element for heating processing solution in the filter housing; and a level sensing probe provided at a predetermined level on the filter housing which approximately defines an acceptable minimum level of processing solution in the filter housing. The level sensing probe is adapted to provide a signal to a controller arrangement to shut off the heating element when a level of processing solution in the filter housing falls below the predetermined level.

The present invention further relates to a method of processing photosensitive material. The method comprises processing photosensitive material in a processor having a processing solution therein; circulating the processing solution from the processor to a filter housing; heating the processing solution in the filter housing; and stopping the heating of the processing solution in the filter housing when a level of processing solution in the filter housing falls below a predetermined level.

The present invention further relates to a processing apparatus for processing photographic material which comprises a processor; a filter assembly adapted to provide filtered processing solution to the processor, with the filter assembly comprising a filter housing have a heating element therein; a level sensing probe provided on the filter housing; and a controller arrangement operationally associated with the level sensing probe and the heating element. The controller arrangement is adapted to turn off the heating element when the processing solution in the filter housing falls below a level on the filter housing as defined by the level sensing probe.

The present invention further relates to a method of processing photosensitive material which comprises supplying a processing solution to a filter housing; heating the processing solution while in the filter housing; supplying the processing solution from the filter housing to a processor for processing photosensitive material; and stopping the heating of the processing solution in the filter housing when a level of the processing solution in the filter housing falls below a predetermined level.

DETAILED DESCRIPTION OF THE INVENTION

Figure 1:
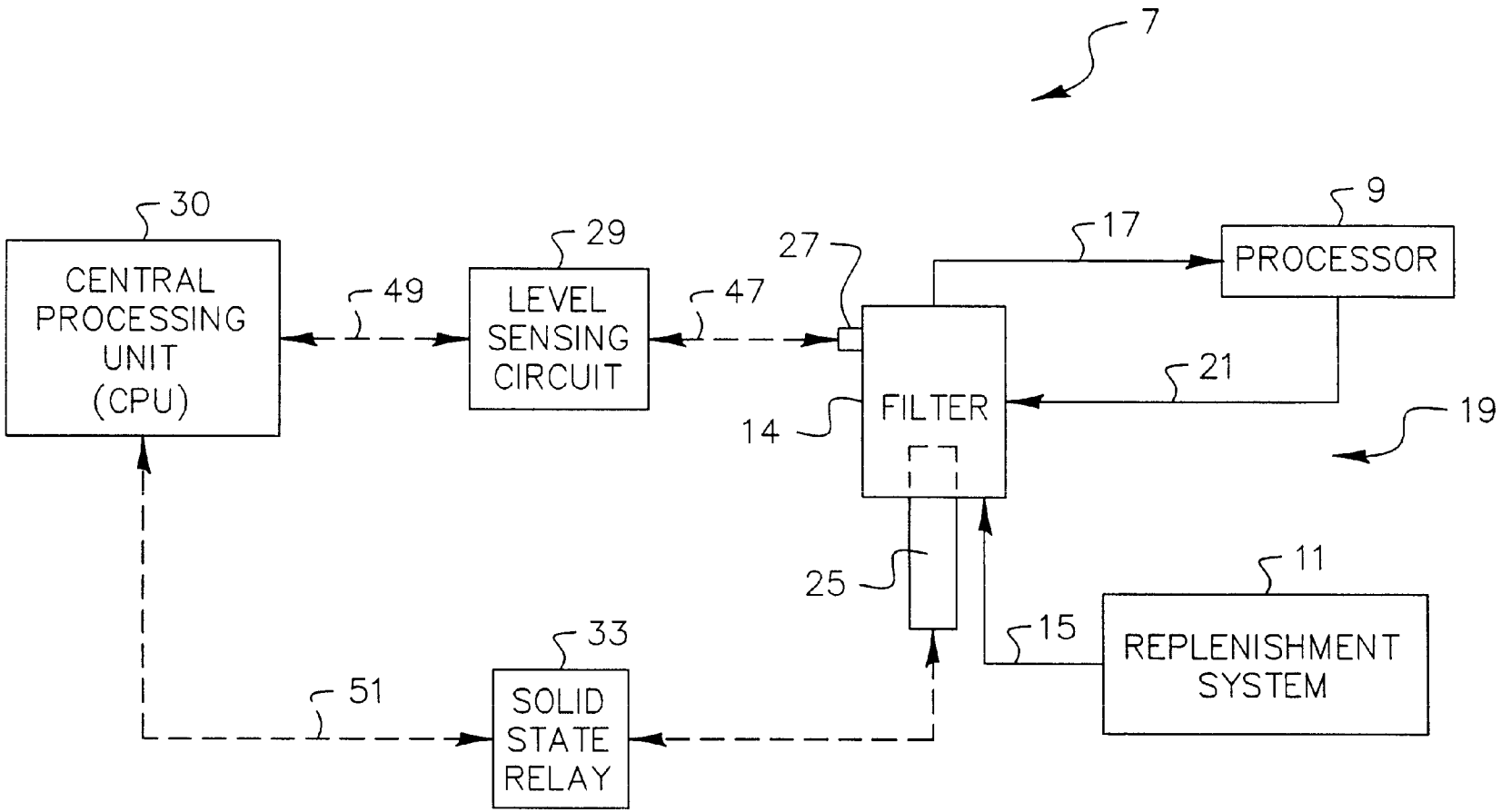
FIG. 1 schematically illustrates a processing system or apparatus in accordance with the present invention.

Referring now to the drawings, wherein like reference numerals represent identical or corresponding parts throughout the several views, FIG. 1 schematically illustrates a processing apparatus 7 in accordance with the present invention. As illustrated in FIG. 1, a processor 9 which can be, for example, a processing tank is schematically shown. Processor 9 holds photographic processing solution for processing photographic material such as film, sheets, etc. Processor 9 could be a rack and tank arrangement as illustrated in, for example, U.S. Pat. Nos. 5,432,581 and 5,508,776. Processor 9 could also be part of a processing assembly that includes a series of tanks each holding a processing solution, such as developer solution, washing solution, bleaching solution, etc., specific to that station or tank. In a rack and tank arrangement, photosensitive material is introduced to the processor via, for example, an entrance pair of rollers, and is conveyed through a narrow processing channel formed between the rack and tank. While the photosensitive material is being conveyed through the processing channel, the photosensitive material is impinged with processing solution by way of nozzles. After processing, the photosensitive material exits the processor via, for example, an exit pair of rollers and is lead to, for example, a further tank or station.

Processing apparatus 7 as illustrated in FIG. 1 further includes a replenishment system schematically illustrated by reference numeral 11. Replenishment system 11 could be, for example, a replenishment arrangement as disclosed in U.S. Pat. Nos. 5,701,540 and 5,753,111. Replenishment system 11 is effective to replenish processing solution in processor 9 as the strength of the processing solution in processor 9 weakens or is used up.

Also shown in FIG. 1 is a filter assembly 14. Filter assembly 14 could be optionally designed to receive replenishment solution from replenishment system 11 by way of, for example, a conduit or fluid line 15, and deliver the solution to processor 9 via, for example, a conduit or fluid line 17.

Also disclosed in FIG. 1 is a circulation system generally identified by reference numeral 19. Circulation system 19 basically includes a conduit or fluid line 21 which receives processing solution via an opening in the bottom of processor 9. Conduit 19 leads the solution to filter assembly 14. Filter assembly 14 is effective to filter particles from the processing solution received via conduit 21 and/or conduit 15. Filter assembly 14 further includes a heating element 25 which is effective to heat the processing solution while in filter assembly 14. After filtering, the solution is circulated to processor 9 via conduit line 17.

In a feature of the present invention, filter assembly 14 includes a level sensing probe 27. Level sensing probe 27 is set at a predetermined level on a housing of filter assembly 14 and is operationally associated with a level sensing circuit 29. As also shown in FIG. 1, a solid state relay 33 is operationally associated with heating element 25 so as to provide power to heating element 25. Both level sensing circuit 29 and solid state relay 33 are controlled by way of a central processing unit (CPU) 30. It is further noted that replenishment system 11 can be controlled by CPU 30 or in a known manner by a further CPU so as to meter the proper amount of replenishment solution in accordance with the need of processor 9.

Figure 2:
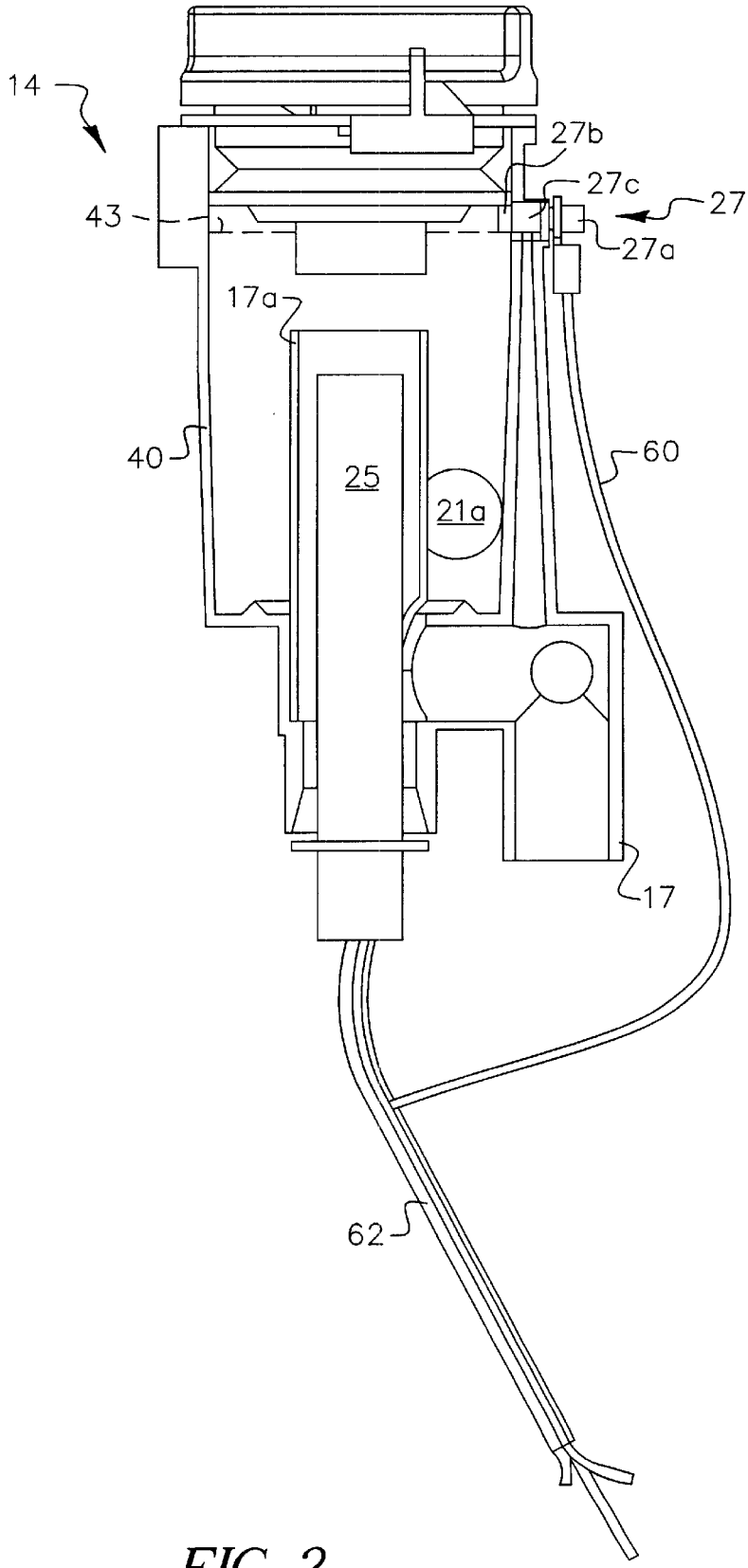
FIG. 2 illustrates a filter assembly used in the processing apparatus of FIG. 1.

With reference to FIG. 2 which illustrates in detail filter assembly 14, it is noted that level sensing probe 27 is mounted or set at a specific level on a filter housing 40 of filter assembly 14. More specifically, level sensing probe 27 is approximately set at a minimum acceptable level for processing solution within housing 40 that will prevent overheating of the components of filter assembly 14. Examples of components for the filter assembly can be seen in U.S. Pat. Nos. 5,701,540 and 5,753,111. Therefore, as processing solution from conduit line 21 or conduit line 15 enters filter housing 40 via, for example, an entrance 21*a*, the processing solution is maintained within filter housing 40 at a minimum level 43 as identified by the level of level sensing probe 27. After filtering, the solution is circulated to processor 9 via an exit path 17*a* of filter housing 40 and conduit line 17.

In general, it is preferable that minimum level 43 approximately matches or is correlated to a level of processing solution in processor 9. If the processing solution within filter housing 40 falls below level 43, level sensing probe 27 provides a signal via, for example, a signal line 47 (FIG. 1) to level sensing circuit 29 to indicate that the level of processing solution within filter housing 40 has fallen below acceptable minimum level 43. This low level signal is thereafter supplied to CPU 30 via, for example, a signal line 49. Upon receiving the low level signal, CPU 30 provides instructions via signal line 51 to turn off solid state relay 33, which then disconnects power to heating element 25.

Accordingly, with the system of the present invention, any time and for whatever reason the processing solution in filter housing 40 falls below minimum level 43 and/or a level as defined by level sensing probe 27, a controller arrangement which includes at least level sensing circuit 29, CPU 30 and solid state relay 33 is activated to turn off heating element 25. With this arrangement, anytime processing solution within filter housing 40 falls below acceptable minimum level 43, overheating to the components of the filter assembly or housing is prevented by turning off heating element 25. It is noted that level sensing circuit 29 and solid state relay 33 could be known elements which receive and process signals in accordance with instructions from a central processing unit.

With respect to level sensing probe 27, in one feature of the invention, level sensing probe 27 can be molded into filter housing 40. A preferred structure for level sensing probe 27 is shown in FIG. 2. In one embodiment, level sensing probe 27 could include a housing 27*c* having a stud 27*a* therein. Level sensing probe 27 could further include an exposed metal 27*b* provided within filter housing 40. The metal is preferably a conductive metal, such as stainless steel, that is impervious to the solution in the filter housing. The signal from level sensing probe 27 could be provided via an electrical line 60 that leads to signal line 47 shown in FIG. 1. Additionally, as illustrated in FIG. 2, heating element 25 can be powered by an electrical wiring 62 which leads to solid state relay 33.

Thus, the present invention provides for a processing apparatus which includes filter assembly 14 that is provided in, for example, a circulation system. The filter assembly 14 includes level sensing probe 27 on filter housing 40 that is provided at a predetermined level on filter housing 40 so as to approximately define an acceptable minimum level of processing solution in filter housing 40. A controller arrangement which includes at least level sensing circuit 29, CPU 30 and solid state relay 33 is operationally associated with level sensing probe 27 and heating element 25. The controller arrangement is adapted to turn off heating element 25 when the processing solution in filter housing 40 falls below a level on filter housing 40 as defined by level sensing probe 27, and more specifically, the predetermined level on filter housing 40 which approximately defines an acceptable minimum level of processing solution in the filter housing.

The present invention further provides for a method of processing photosensitive material in which during the processing of the photosensitive material, heating element 25 can be shut-off when the level of processing solution in filter housing 40 falls below the predetermined level.

The present invention further provides for a recirculation system which includes CPU 30, level sensing circuit 29 and the solid state relay 33, in which level sensing circuit 29 can receive a low fluid level signal from level sensing probe 27 which is indicative of a low level of solution in filter housing 40.

With the arrangement of the present invention, it is possible to prevent an overheating of components of the filter assembly. More specifically, rather than having a heating element responsive to the temperature in a filter housing which is activated or on all the time, the heating element of the present invention is responsive to the level of processing solution in the filter housing, and can be automatically turned off whenever the processing solution level in the filter housing falls below an acceptable minimum level.

The invention has been described in detail with particular reference to certain preferred embodiments thereof, but it will be understood that variations and modifications can be effected within the spirit and scope of the invention.

What is claimed is:

1. A processing apparatus for processing photographic material, the apparatus comprising:

a processor;

a circulation system for circulating processing solution to and from said processor;

a filter assembly provided in said circulation system, said filter assembly comprising a filter housing having a heating element therein, said heating element being adapted to heat processing solution in said filter housing;

a level sensing probe provided at a predetermined level on said filter housing; and a controller arrangement operationally associated with said level sensing probe and said heating element, said controller arrangement being adapted to turn off said heating element when the processing solution in said filter housing falls below a level on said housing as defined by said level sensing probe.

2. An apparatus according to claim 1, wherein said predetermined level on said filter housing approximately defines an acceptable minimum level of processing solution in the filter housing.

3. An apparatus according to claim 1, wherein said controller arrangement comprises:

a level sensing circuit operationally associated with said level sensing probe;

a solid state relay which provides power to said heating element; and a central processing unit operationally associated with said level sensing circuit and said solid state relay;

wherein, when the solution in said filter housing falls below the level of the level sensing probe:

said level sensing circuit receives a signal from said level sensing probe and provides a low solution level signal to said central processing unit;

said central processing unit receives said low solution level signal from said level sensing circuit and turns off said solid state relay in response thereto; and said solid state relay disconnects power to said heating element.

4. An apparatus according to claim 1, wherein said level sensing probe is molded into said filter housing.

5. An apparatus according to claim 2, wherein said predetermined level approximately matches a level of processing solution in said processor.

6. A filter assembly for a photographic processor, the filter assembly comprising:

a filter housing adapted to hold a processing solution therein;

a heating element for heating processing solution in said filter housing; and a level sensing probe provided at a predetermined level on said filter housing which approximately defines an acceptable minimum level of processing solution in the filter housing, said level sensing probe being adapted to provide a signal to a controller arrangement to shut off the heating element when a level of processing solution in said filter housing falls below said predetermined level.

7. A filter assembly according to claim 6, wherein said level sensing probe is molded in a side of said filter housing.

8. A method of processing photosensitive material, the method comprising:

processing photosensitive material in a processor having processing solution therein;

circulating the processing solution from the processor to a filter housing;

heating the processing solution while in said filter housing; and stopping the heating of the processing solution in the filter housing when a level of processing solution in the filter housing falls below a predetermined level.

9. A method according to claim 8, wherein said heating step comprises positioning a heating element in said filter housing.

10. A method according to claim 9, wherein said step of stopping the heating of the processing solution in the filter housing comprises:

placing a level sensing probe in a side of said filter housing at said predetermined level; and sending a low solution level signal from the level sensing probe to a controller arrangement when the level of processing solution in said filter housing falls below the level sensing probe, said controller arrangement being adapted to disconnect power to the heater when the low solution level signal is received from the level sensing probe.

11. A method according to claim 8, comprising the further step of:

circulating the processing solution from the filter housing to the processor.

12. A processing apparatus for processing photographic material, the apparatus comprising:

a processor;

a filter assembly adapted to provide filtered processing solution to said processor, said filter assembly comprising a filter housing having a heating element therein;

a level sensing probe provided on said filter housing; and a controller arrangement operationally associated with said level sensing probe and said heating element, said controller arrangement being adapted to turn off said heating element when the processing solution in said filter housing falls below a level on said filter housing as defined by said level sensing probe.

13. A method of processing photosensitive material, the method comprising:

supplying a processing solution to a filter housing;

heating the processing solution while in said filter housing;

supplying the processing solution from the filter housing to a processor for processing photosensitive material; and stopping the heating of the processing solution in the filter housing when a level of the processing solution in the filter housing falls below a predetermined level.

14. A method according to claim 13, wherein said heating step comprises positioning a heating element in said filter housing.

* * * * *